US006167569B1

(12) United States Patent
Conner, IV

(10) Patent No.: US 6,167,569 B1
(45) Date of Patent: Jan. 2, 2001

(54) CONVERTIBLE HAT AND PACK APPARATUS

(76) Inventor: William P. Conner, IV, B.C. Hats, P.O. Box 602, St. Augustine, FL (US) 32085-0602

( * ) Notice: Under 35 U.S.C. 154(b), the term of this patent shall be extended for 0 days.

(21) Appl. No.: 09/426,589

(22) Filed: Oct. 25, 1999

Related U.S. Application Data

(60) Provisional application No. 60/110,879, filed on Dec. 4, 1998.

(51) Int. Cl.[7] ..... A42B 1/00

(52) U.S. Cl. ..... 2/209.11; 2/195.1; 224/577; 224/664

(58) Field of Search ..... 2/209.11, 209.12, 2/195.1, 195.4, 175.1; 224/577, 660, 664

(56) References Cited

U.S. PATENT DOCUMENTS 1,269,594 * 6/1918 Geraghty .
4,165,542 * 8/1979 McLaughlin .
4,610,038 * 9/1986 Dennard .
5,173,970 * 12/1992 Shifrin .
5,214,802 * 6/1993 McCallum ..... 2/196
5,303,427 * 4/1994 Fishbaine .
5,367,713 * 11/1994 McCallum ..... 2/209.12
5,450,629 * 9/1995 Gilstrap .
5,613,246 * 3/1997 Alexander ..... 2/10
5,694,648 * 12/1997 Nucifora ..... 2/172

FOREIGN PATENT DOCUMENTS

412335 * 7/1910 (FR) .
447209 * 10 1915 (FR) .

* cited by examiner

*Primary Examiner*—Bibhu Mohanty
(74) *Attorney, Agent, or Firm*—Richard C. Litman

(57) ABSTRACT

A combination hat and pack apparatus that can be used as a cap or fanny pack. In a cap configuration, the apparatus is defined by a concave portion forming a hat and a brim portion forming a brim of a cap. An elastic belt enables the apparatus to be secured around one's waist when the apparatus is configured as a fanny pack. A plurality of belt loops or belt receiving slits on an outside surface of the concave portion retain the belt in a fixed position when the apparatus is configured as a cap. A zipper fastener on the concave portion edge and a peripheral edge of the brim portion selectively attaches the brim to the concave portion to form a fanny pack.

12 Claims, 4 Drawing Sheets

CONVERTIBLE HAT AND PACK APPARATUS

CROSS-REFERENCE TO RELATED APPLICATION

This application claims the benefit of U.S. Provisional Patent Application Serial No. 60/110,879, filed Dec. 4, 1998.

BACKGROUND OF THE INVENTION

1. Field of the Invention

The present invention relates generally to multi-functional hat and pack combinations and, more particularly, to a hat apparatus that can be modified for use also as a fanny pack.

2. Description of Related Art

Hats have been used for many years and are found in many shapes and sizes. Hats are used as sun shades, to repel the weather and often simply for aesthetic purposes. A popular hat is the baseball-style cap. A modern baseball cap typically includes a shell, a visor attached to an edge of the shell to shade the user, and an adjustment strap system along the edge of the shell to allow for changing the size of the hat. The shell is typically made of flexible material. The visor is typically made of a more rigid material and extends away from the shell to provide shade for the user's face.

When hats are worn for any of their many uses, the user often desires to remove the hat from his or her head, but keep the hat available for later use. If the user is participating in an activity at the time, such as hiking or some other sport, storing the hat for later use can pose a problem.

Most hats must simply be carried by hand or in some type of carrier when not in use. Carrying a hat by hand subjects the hat to damage from exposure to dirt or physical damage such as being crushed or otherwise deformed. Using a carrier for a hat is inconvenient for the active user. Storing hats while not in use is a recognized problem, indicated by numerous attempts of others to provide a hat that is conveniently storable and portable.

Attempts to create hats that are able to be reduced to a convenient size have concentrated on rolling the hats into a roll, folding visors in one or a plurality of locations, and also folding both the visor and the shell together. U.S. Pat. No. 1,213,447 issued to R. H. Bacon in 1917 discloses a visor made up of separate sections held together by pliable hinge strips. The visor is foldable to a reduced size, but still must be placed somewhere for storage, and provides no extra functionality when in its reduced size.

U.S. Pat. No. 625,776 issued to C. H. Von Klein in 1899 discloses a hat that has a foldable body and a visor that is hinged at one place to fold over itself. While the hat is reduced in size, the shape of the hat in its reduced size is as difficult to store as the hat in its normal state.

U.S. Pat. No. 4,610,038 issued to Dennard in 1986 discloses a hat/tote bag combination article. However the article of Dennard does not disclose a structure for securing the article around an individual's waist.

U.S. Pat. No. 5,173,970 issued to Shifrin in 1992 discloses a combined visored cap type protective helmet and pouch for bicyclist or the like. However, the helmet and pouch of Shifrin fails to disclose enclosing the cap in a pouch configuration.

U.S. Pat. No. 5,303,427 issued to Fishbaine in 1994 discloses a combination hat and bag article. However, the combination article lacks a support for the bag around an individual's waist.

U.S. Pat. No. 5,367,713 issued to McCallum in 1994 discloses a convertible hat and bag assembly that can be worn as a hat or as a bag that is worn around an individual's waist. However, the convertible hat and bag assembly of McCallum does not disclose the assembly comprising an elastic waist belt for enabling the belt to expand to an appropriate length for wrapping around an individual's waist. Moreover, the convertible hat and bag assembly of McCallum does not disclose a plurality of belt loops attached a concave portion thereof for selectively supporting a belt therefrom.

U.S. Pat. No. 5,450,629 issued to Gistrap in 1995 discloses a convertible hat with a foldable visor. However, Gistrap fails to disclose any article to be worn by an individual.

Other related art discloses combination hat and pack articles. However, none of the references disclose a combination hat and fanny pack apparatus having an elastic belt for enabling the belt to expand to fit around a person's waist. Furthermore, none of the references disclose a combination hat and fanny pack apparatus having belt loops attached thereto for retaining a belt in a fixed position around a concave portion of the hat when the belt is not being used.

None of the above inventions and patents, taken either singly or in combination, is seen to describe the instant invention as claimed.

SUMMARY OF THE INVENTION

The present invention is a convertible hat and bag apparatus for use as a hat or fanny pack. The apparatus being defined by a concave portion shaped for placement onto a person's head. A plurality of belt loops are attached to the concave portion for retaining a belt in a fixed position around the concave portion when the belt is not being used to support the apparatus on a person's waist. An elastic belt on the concave portion supports the concave portion around an individual's waist in a fanny pack configuration. The belt has first and second portions releasably attached together by a fastening apparatus.

Accordingly, it is a principal object of the invention to provide a combination cap and fanny pack apparatus defined by a concave portion having an elastic belt for enabling the belt to expand to fit around a waist of practically any size.

It is another object of the invention to provide a combination cap and fanny pack apparatus defined by a concave portion having a plurality of attached belt loops for retaining a belt in a fixed position around the concave portion when the belt is not being used for securing the pack to a wearer's waist.

It is a further object of the invention to provide a combination cap and fanny pack apparatus having a zipper fastener on a peripheral edge thereof for selectively fastening together opposing sides thereof to form a fanny pack configuration.

Still another object of the invention is to provide a combination cap and fanny pack apparatus having belt with a fastening apparatus attached thereto, the fastening apparatus including a male portion attached to a first half of the belt and a female portion attached to a second half of the belt for releasably attaching the two halves around a person's waist.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
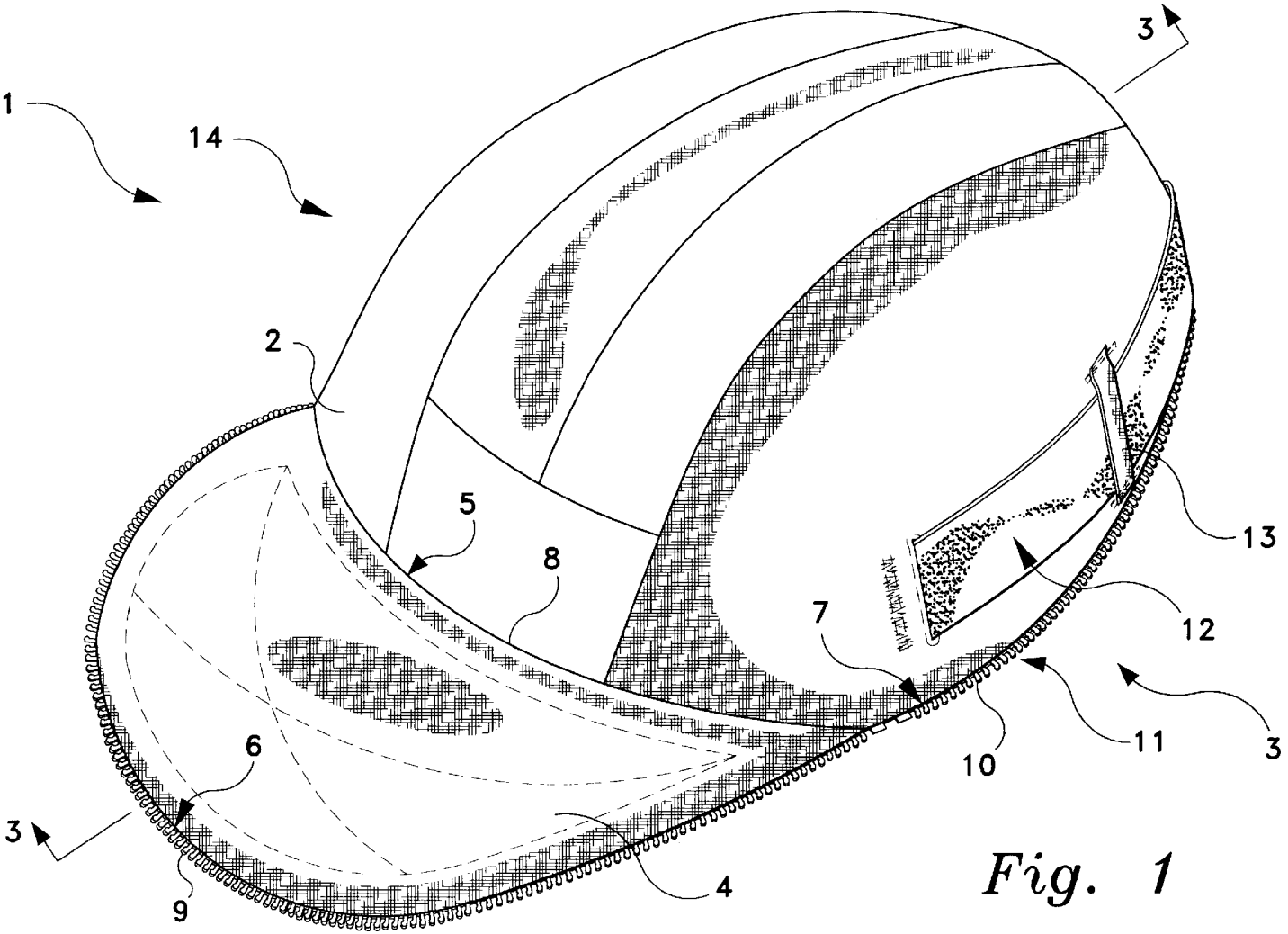
FIG. 1 is a perspective view of a cap/fanny pack combination in a cap configuration according to a first embodiment of the present invention.

The present invention is a combination hat and bag apparatus that can be worn either as a cap or as a fanny pack. FIG. 1 shows a combination hat and pack apparatus 1 according to a first embodiment of the present invention. As shown in FIG. 1, the apparatus 1 is configured as a cap 14. The combination hat and bag apparatus 1 is defined by a concave portion 2 having a first peripheral edge 3 forming an opening for placement onto a person's head. The apparatus 1 is constructed entirely of flexible materials for permitting the apparatus to be easily reconfigured between a cap configuration and a fanny pack configuration. Preferably, the concave portion is made of a cotton material. The first peripheral edge 3 is defined by a first peripheral portion 7 and a second peripheral portion 8.

Attached to the second peripheral portion 8 is a brim 4 for forming a brim on the concave portion 2 when configured as a cap 14. The brim 4 is defined by a third peripheral edge 5 and a fourth peripheral edge 6. The third peripheral edge 5 is preferably attached the second peripheral portion 8 by conventional stitching for securing the third peripheral edge 5 to the second peripheral portion 8. The brim 4 is preferably made of a cotton material with a foam material contained inside the cotton material to provide added rigidity to the brim 4.

The convertible hat and pack apparatus 1 has a zipper fastener 11 attached to the first peripheral portion 7 and the fourth peripheral edge 6 for selectively attaching the first peripheral portion 7 to the fourth peripheral edge 6. Conventional stitching is used to attached the zipper fastener to the first peripheral portion 7 and the fourth peripheral edge 6.

The zipper fastener 11 has mating portions 9 and 10. Portion 9 is attached to the fourth peripheral edge 6 for enabling the fourth peripheral edge 6 to be selectively attached to zipper portion 10 of the first peripheral portion 7. FIG. 1 illustrates the configuration of the combination hat and pack apparatus 1 when the zipper fastener 11 is unfastened.

The concave portion 2 is further defined by an elastic belt 12, which supports the combination hat and pack apparatus 1 from a person's waist when configured as a fanny pack, discussed in greater detail hereinbelow. Preferably, the belt 12 is a ¼ inch elastic strip. On the outside of the concave portion 2 adjacent to and above the first peripheral portion 7 are a plurality of belt loops 13 for retaining the elastic belt in a fixed position around the concave portion when the belt is not being used.

Figure 2:
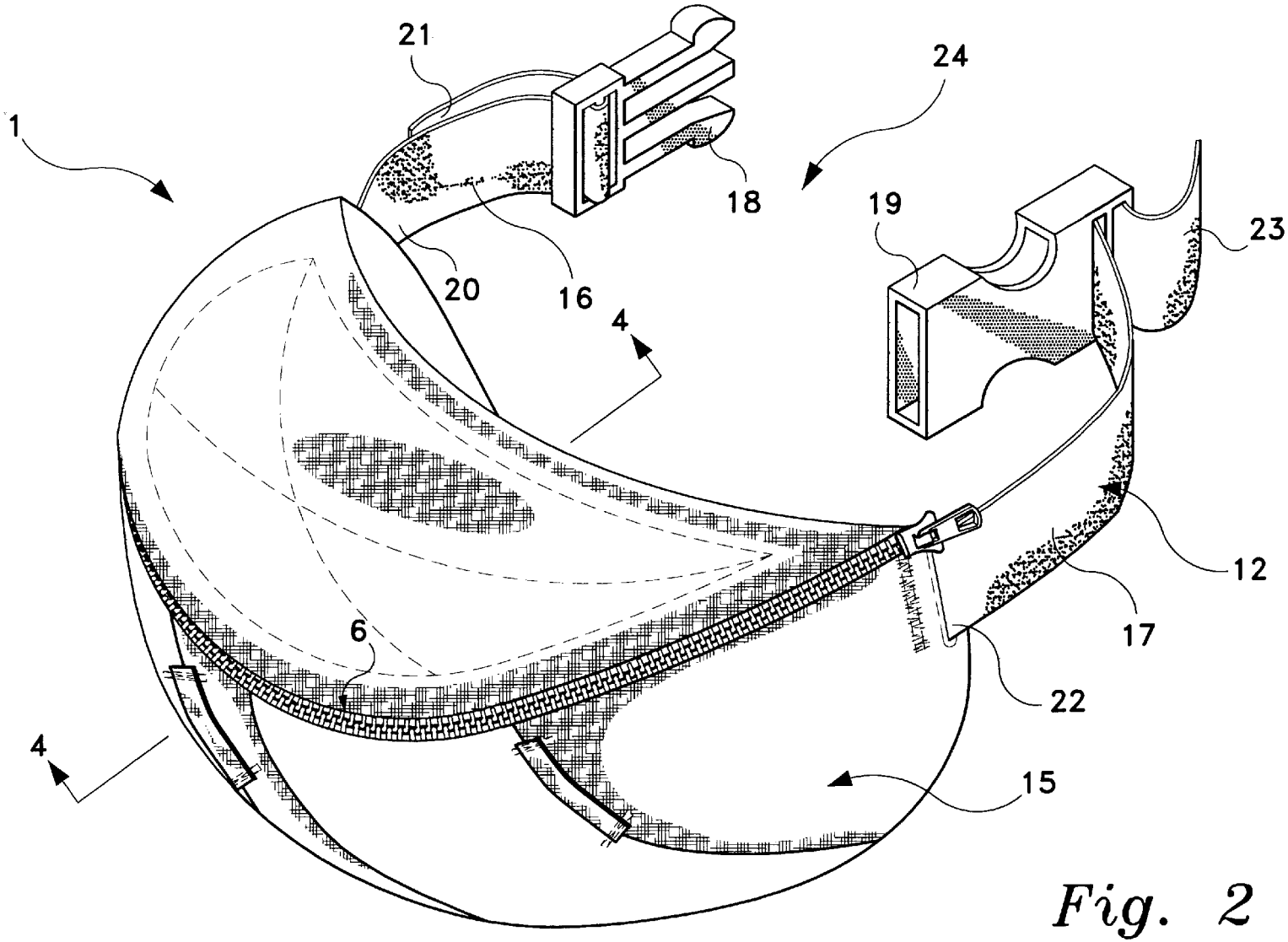
FIG. 2 is a perspective view of a cap/fanny pack combination in a fanny pack configuration according to the first embodiment of the invention.

FIG. 2 shows the combination hat and pack apparatus 1 configured as a fanny pack 15, with the zipper fastener 11 fully fastened. In this fully fastened configuration, the brim 4 is folded over the concave portion 2, with the fourth peripheral edge 6 joining the first peripheral portion to form a fanny pack 15. As shown in FIG. 2, the elastic belt 12 is removed from the belt loops 13 in this fanny pack configuration, so that the belt 12 can be wrapped around a person's waist. The belt 12 is made of an elastic material for enabling the belt to expand to fit a variety of waist sizes.

Figures 3, 4:
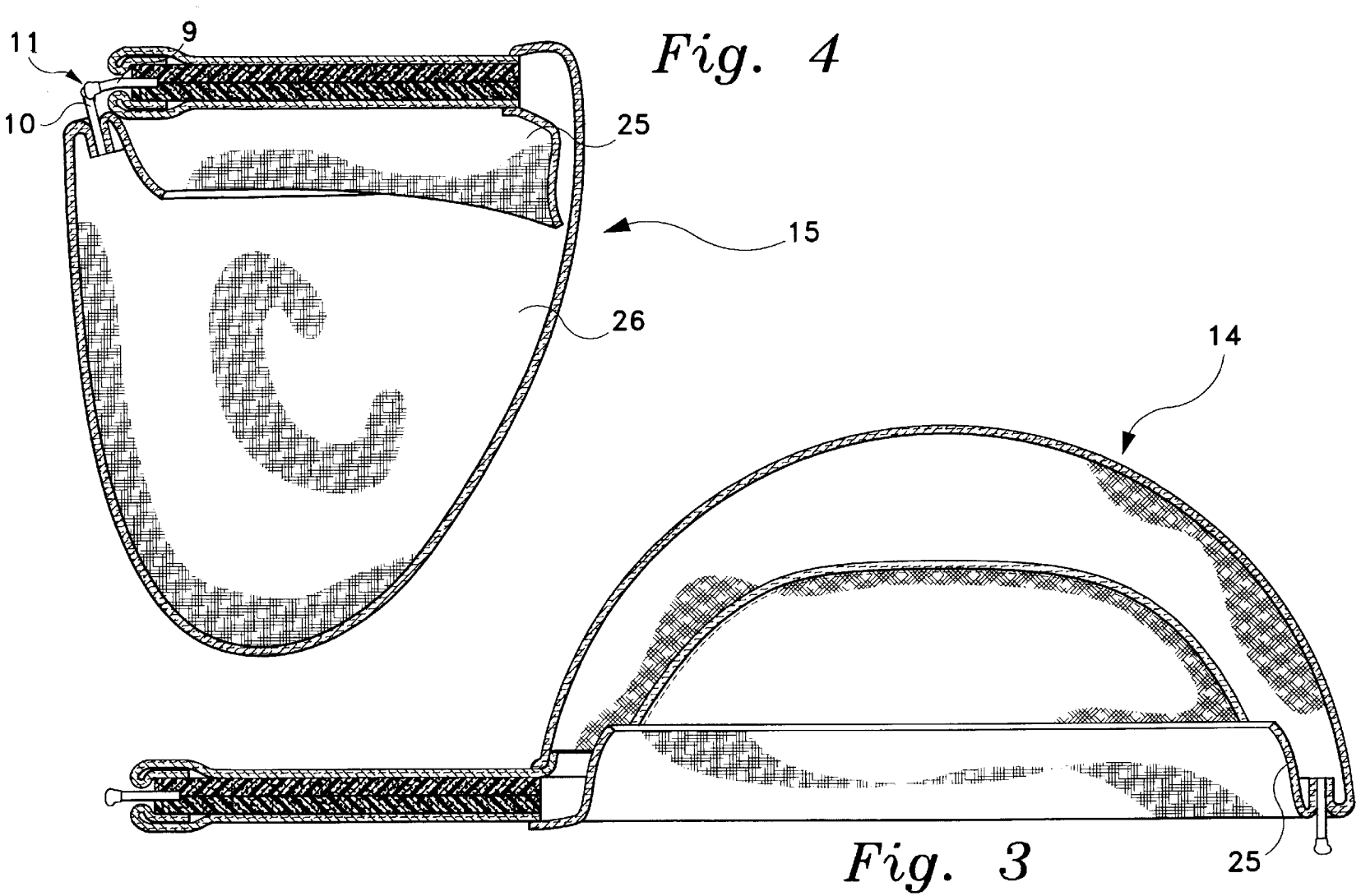
FIG. 3 is a cross-sectional view taken along line 3—3 of the cap/fanny pack combination shown in FIG. 1.
FIG. 4 is a cross-sectional view taken along line 4—4 of the cap/fanny pack combination shown in FIG. 2.

As shown in FIG. 3, the cap 14 is further defined by a layer 25 of absorbent material on the first peripheral edge 3, for absorbing perspiration from a person's head when the cap 14 is being worn by an individual. Preferably, the layer 25 is made of terry cloth material. The layer 25 of absorbent material is folded into the inside of the concave portion 2 so that the layer 25 contacts the head of a person wearing the cap 14.

As shown in FIG. 2, the elastic belt 12 has a first half 16 and a second half 17. The first half 16 is fixed at 20 to the concave portion 2, and has a free end 21 at an opposing end thereof. Similarly, the second half 17 is fixed at 22 to the concave portion 2, and has a free end 23 at an opposing end thereof.

The elastic belt 12 has a fastening apparatus 24 for releasably attaching the first half 16 and the second half 17. The fastening apparatus 24 is a conventional latch-type fastener that includes a male latch 18 and a female latch 19 that snaps into a locked position, and can be squeezed for easy release. Preferably, the fastening apparatus is a plastic side-latch buckle. The male latch 18 is attached to the free end 21 of the first half 16. Preferably, the male latch 18 has two conventional slots formed in one end for permitting the belt half 16 to be weaved therethrough. Preferably, the first half 16 is folded over approximately ½ inch from the free end 21 and sewn together after being weaved through the two slots to prevent the male latch 18 from being removed from the first half.

Similarly, the female latch 19 is attached to the free end 23 of the second belt half 17 for providing a means to attach the second belt half 17 to the first belt half 16. Preferably, the female latch 19 has two slots formed in one end for permitting the second belt half 17 to be weaved through the slots, to attach the second half 17 to the female latch 19. Additionally, the second belt half 17 is preferably folded over approximately ½ inch from the free end 23 and sewn together after being weaved through the two slots to prevent the female latch 19 from being removed from the first half.

FIG. 4 clearly shows the male portion 9 of the zipper fastener 11 when it is engaged with the female portion 10. FIG. 4 also clearly shows the cavity 26 formed inside the fanny pack 15 when the zipper fastener 11 is positioned in the fully fastened configuration.

Figure 5:
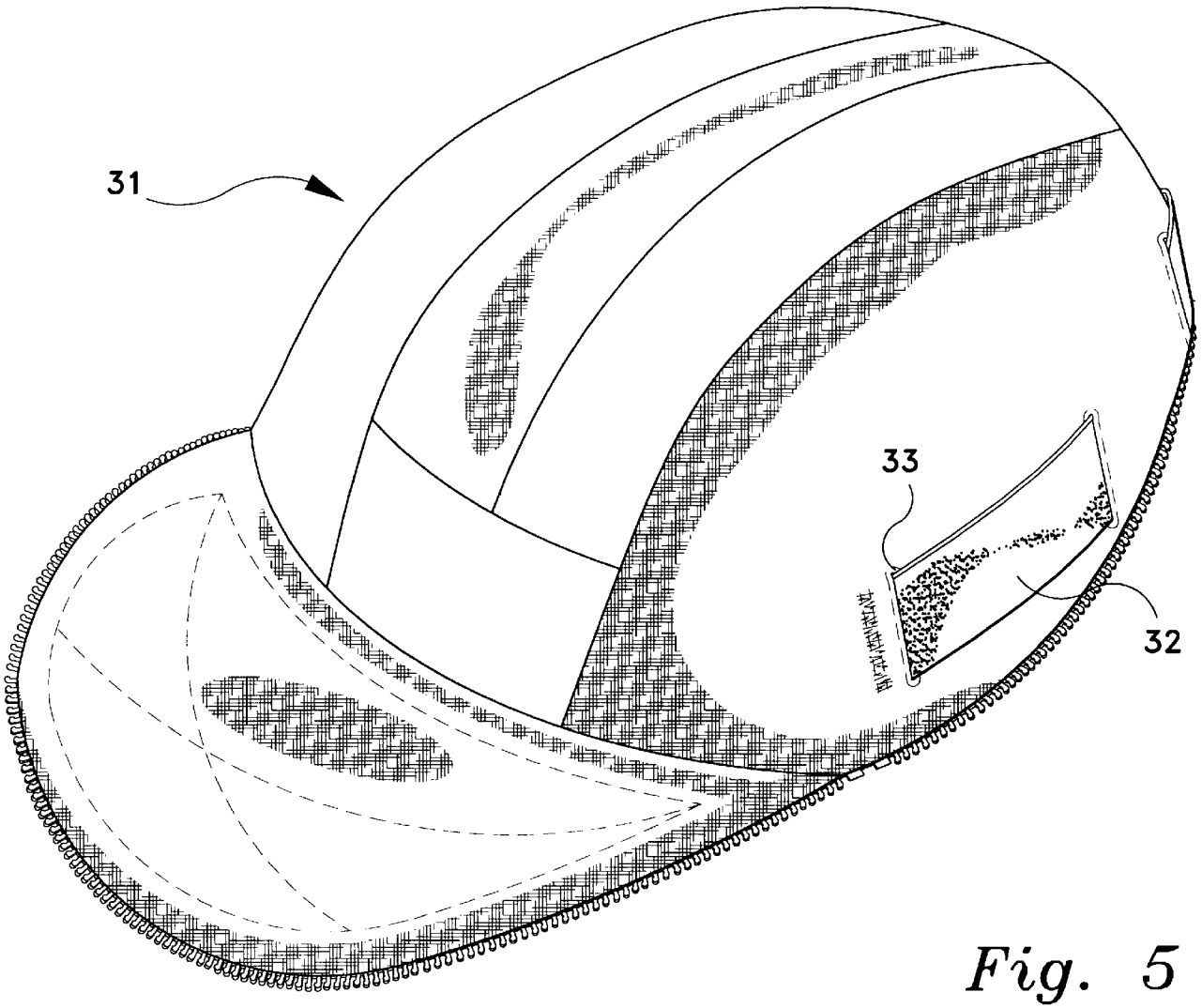
FIG. 5 is a perspective view of a cap/fanny pack combination in a cap configuration according to a second embodiment of the present invention.

A combination hat and bag apparatus 31 according to a second embodiment of the present invention is shown in FIG. 5. The combination hat and bag apparatus 31 is identical to the apparatus 1 defined for the first embodiment except that the plurality of belt loops 13 have been replaced by a plurality of slits 33 formed in the concave portion 2 for retaining the belt 12 in a fixed position around the concave portion 2 when the belt is not being used to support the apparatus 31 from an individual's waist.

It is to be understood that the present invention is not limited to the embodiments described above, but encompasses any and all embodiments within the scope of the following claims.

I claim:

1. A convertible hat and pack apparatus, comprising:

a concave portion shaped for placement on a wearer's head or for forming a pack, the concave portion having a first peripheral edge forming a head-receiving opening, and a second peripheral portion;

a waist belt;

a plurality of belt securement means, attached to said concave portion, for selectively housing said waist belt;

said waist belt being made up of elastic waist belt portions, each having free ends selectively passed through said plurality of belt securement means for securing said waist belt portions to said concave portion in a storage configuration;

a fastening apparatus attached to said free ends of said elastic waist belt for releasably attaching opposing ends of said elastic waist belt around a person's waist, said apparatus comprising mating male and female latch elements;

a brim portion defined by a third peripheral edge and a fourth peripheral edge, said third peripheral edge is fixedly attached to said second peripheral portion for attaching said brim portion to said concave portion, said fourth peripheral edge forms an outer edge of said brim portion; and a zipper fastener fixedly attached to said first peripheral edge and said fourth peripheral edge for selectively fastening said concave portion to said brim portion to form a pack.

2. The convertible hat and bag apparatus as recited in claim 1, wherein said belt securement means comprise a plurality of belt loops on said concave portion, and stitching means for securing said plurality of belt loops to said concave portion.

3. The convertible hat and bag apparatus as recited in claim 1, wherein said belt securement means comprise a plurality of slits formed in said concave portion, through which said waist belt portions are inserted.

4. The convertible hat and bag apparatus as recited in claim 1, further comprising a first stitching means for securing said third peripheral edge to said second peripheral portion.

5. The convertible hat and bag apparatus as recited in claim 4, further comprising a second stitching means for securing said zipper fastener to said first and fourth peripheral edges.

6. The convertible hat and bag apparatus as recited in claim 1, wherein said brim portion is made of a flexible material, for enabling said brim portion to bend when converting said apparatus from a hat to a pack.

7. The convertible hat and bag apparatus as recited in claim 5, wherein said flexible material is a non-permeable foam.

8. The convertible hat and bag apparatus as recited in claim 1, wherein said fastening apparatus is a dual ladder-lock, side-release clip.

9. The convertible hat and bag apparatus as recited in claim 1, wherein said male and female latch elements further include slot means for selectively retaining and detaching said elements from said belt portion free ends, said latch elements being removed when said apparatus is in a pack configuration.

10. A convertible hat and pack apparatus, comprising:

a concave portion shaped for placement on a wearer's head or for forming a pack, the concave portion having a first peripheral edge and a second peripheral portion forming a head-receiving opening;

a waist belt;

a plurality of belt securement means, attached to said concave portion, for selectively housing said waist belt;

said waist belt being made up of elastic waist belt portions, each having free ends selectively passed through said plurality of belt securement means for securing said waist belt portions to said concave portion in a storage configuration;

a fastening apparatus attached to said free ends of said elastic waist belt for releasably attaching opposing ends of said elastic waist belt around a person's waist, said apparatus comprising mating male and female latch elements;

wherein said fastening apparatus is a dual ladder-lock, side-release clip;

wherein said male and female latch elements further include slot means for selectively retaining and detaching said elements from said belt portion free ends, said latch elements being removed when said apparatus is in a pack configuration;

a brim portion defined by a third peripheral edge and a fourth peripheral edge, said third peripheral edge is fixedly attached to said second peripheral edge for attaching said brim portion to said concave portion, said fourth peripheral edge forms an outer edge of said brim portion;

first stitching means for securing said third peripheral edge to said second peripheral portion wherein said brim portion is made of a flexible material, for enabling said brim portion to bend when converting said apparatus from a hat to a pack;

a zipper fastener fixedly attached to said first peripheral edge and said fourth peripheral edge for selectively fastening said concave portion to said brim portion to form a pack; and a second stitching means for securing said zipper fastener to said first and fourth peripheral edges.

11. The convertible hat and bag apparatus as recited in claim 10, wherein said belt securement means comprise a plurality of belt loops on said concave portion, and stitching means for securing said plurality of belt loops to said concave portion.

12. The convertible hat and bag apparatus as recited in claim 10, wherein said belt securement means comprise a plurality of slits formed in said concave portion, through which said waist belt portions are inserted.

* * * * *